US010648641B2

(12) United States Patent
Abe

(10) Patent No.: US 10,648,641 B2
(45) Date of Patent: May 12, 2020

(54) VEHICLE LAMP

(71) Applicant: Ichikoh Industries, Ltd., Isehara-shi (JP)

(72) Inventor: Toshiya Abe, Isehara (JP)

(73) Assignee: Ichikoh Industries, Ltd., Isehara-shi (JP)

( * ) Notice: Subject to any disclaimer, the term of this patent is extended or adjusted under 35 U.S.C. 154(b) by 0 days.

(21) Appl. No.: 16/326,583

(22) PCT Filed: Aug. 21, 2017

(86) PCT No.: PCT/JP2017/029770
§ 371 (c)(1),
(2) Date: Feb. 19, 2019

(87) PCT Pub. No.: WO2018/038048
PCT Pub. Date: Mar. 1, 2018

(65) Prior Publication Data

US 2019/0211992 A1 Jul. 11, 2019

(30) Foreign Application Priority Data

Aug. 22, 2016 (JP) ..... 2016-162106

(51) Int. Cl.
*F21S 45/47* (2018.01)
*F21V 19/00* (2006.01)
(Continued)

(52) U.S. Cl.
CPC ..... *F21S 45/47* (2018.01); *F21V 19/00* (2013.01); *F21V 29/503* (2015.01); *F21V 29/70* (2015.01)

(58) Field of Classification Search
CPC ... F21V 19/003; F21V 29/70–83; F21S 45/47
See application file for complete search history.

(56) References Cited

U.S. PATENT DOCUMENTS

2005/0248626 A1 11/2005 Akahane et al.
2008/0192462 A1* 8/2008 Steedly ..... F21V 19/0055 362/218
(Continued)

FOREIGN PATENT DOCUMENTS

JP 2004-98676 A 4/2004
JP 2012-234078 A 11/2012
(Continued)

OTHER PUBLICATIONS

International Search Report dated Nov. 21, 2017 in PCT/JP2017/029770 filed Aug. 21, 2017.

*Primary Examiner* — Sean P Gramling
(74) *Attorney, Agent, or Firm* — Oblon, McClelland, Maier & Neustadt, L.L.P.

(57) ABSTRACT

A vehicle lamp comprises: a substrate; a semiconductor light source which is mounted on the substrate; a lens which emits light from the semiconductor light source; and a heat sink having a planar first surface which is formed in the shape of a plate from a metal material, is in contact with and affixed to the substrate, and supports the lens, and a planar second surface which is the back surface of the first surface, the heat sink being plastically deformed by a plurality of recesses disposed in a prescribed pattern in a surface machining area on the second surface that includes an area on the back side of the contact area.

5 Claims, 7 Drawing Sheets

(51) Int. Cl.
*F21V 29/503* (2015.01)
*F21V 29/70* (2015.01)

(56) References Cited

U.S. PATENT DOCUMENTS

2012/0281167 A1* 11/2012 Nakatsuka ..... G02F 1/133615 349/69
2016/0265758 A1* 9/2016 Funakoshi ..... H05K 1/0209

FOREIGN PATENT DOCUMENTS

JP 2013-131388 A 7/2013
JP 2015-222673 A 12/2015

* cited by examiner

[FIG. 1]
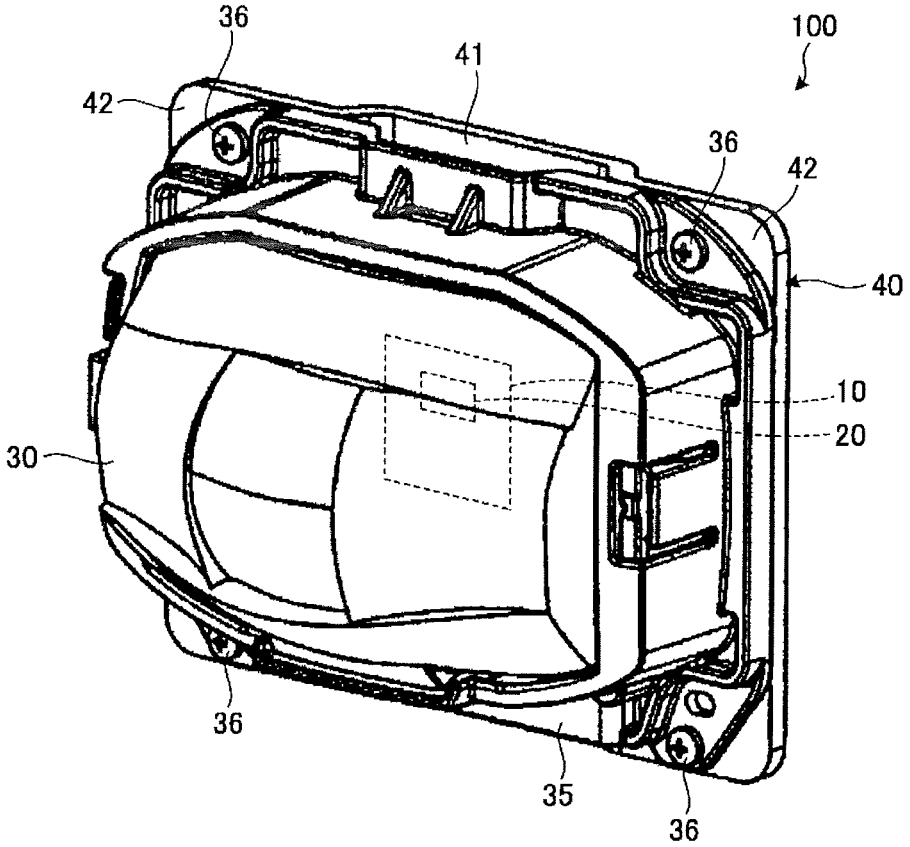

[FIG. 2]
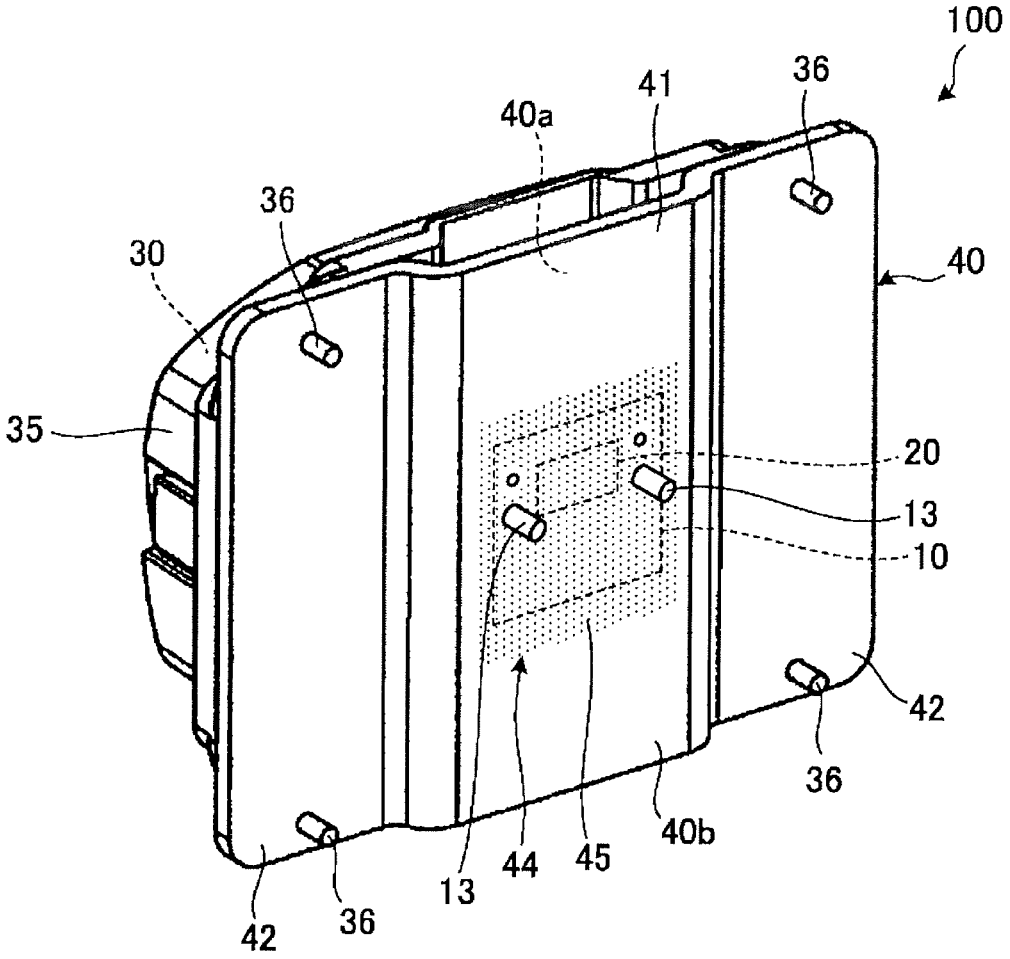

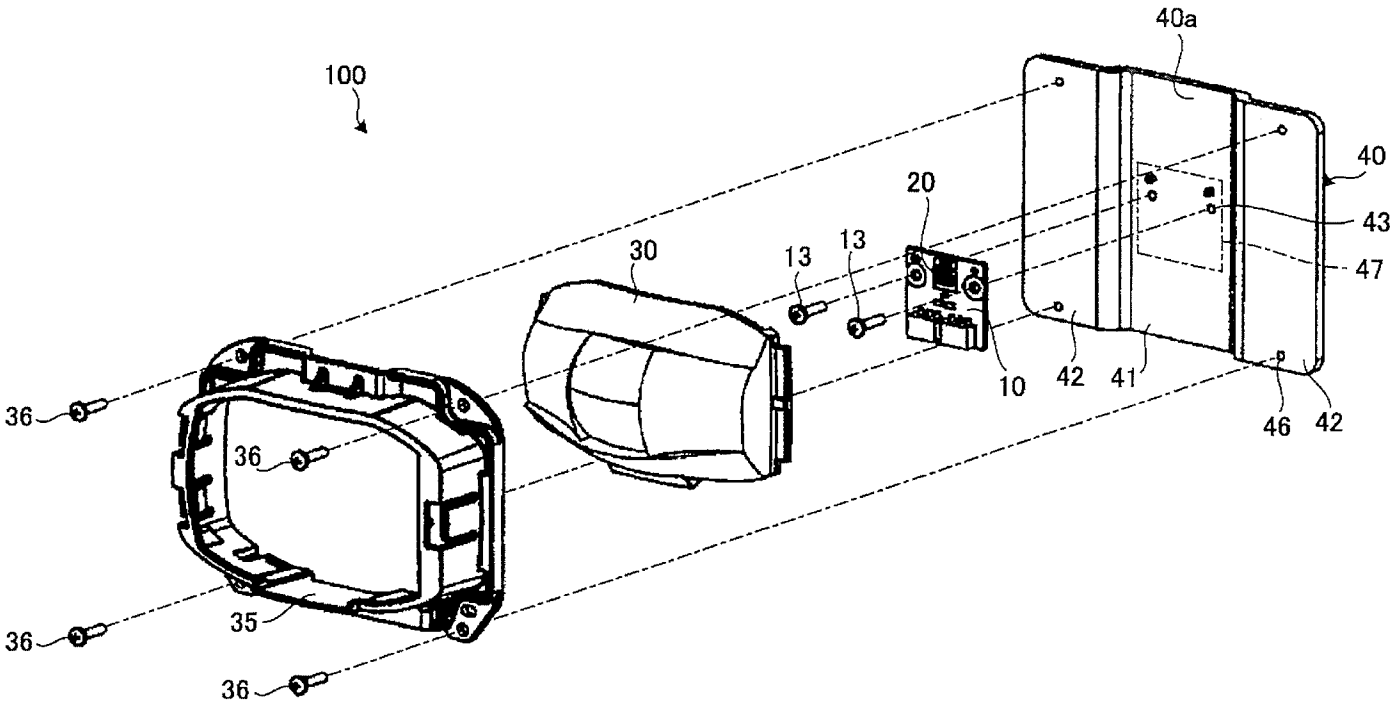
[FIG. 3]

[FIG. 4]
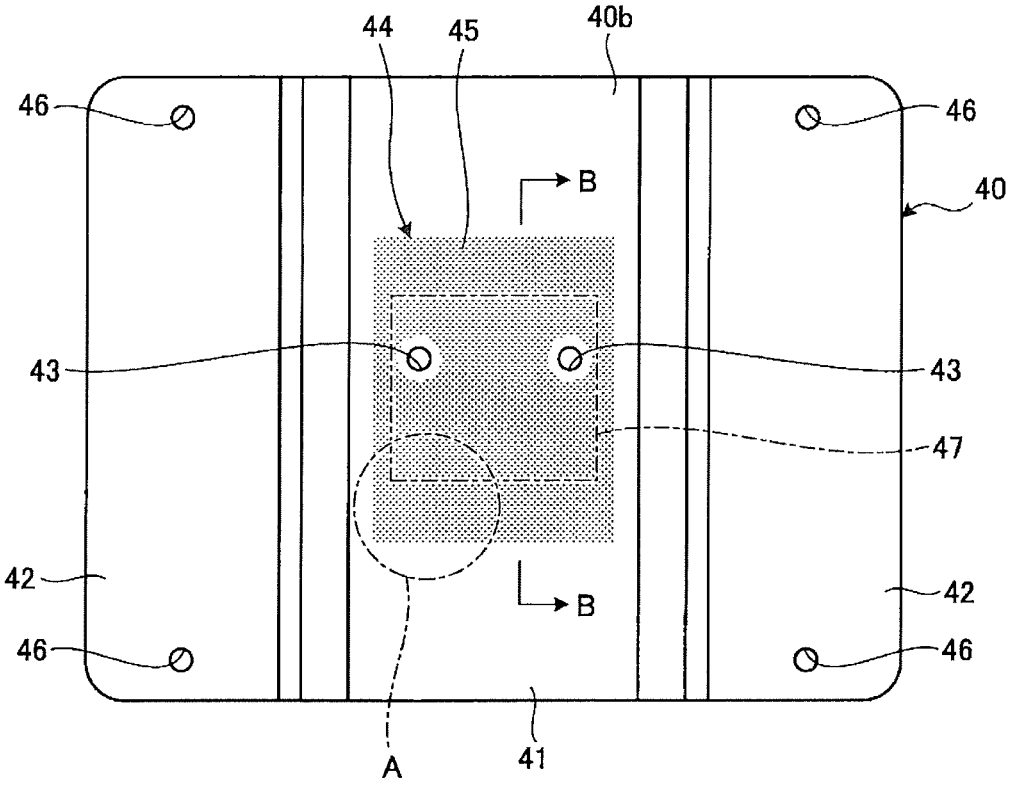

[FIG. 5]
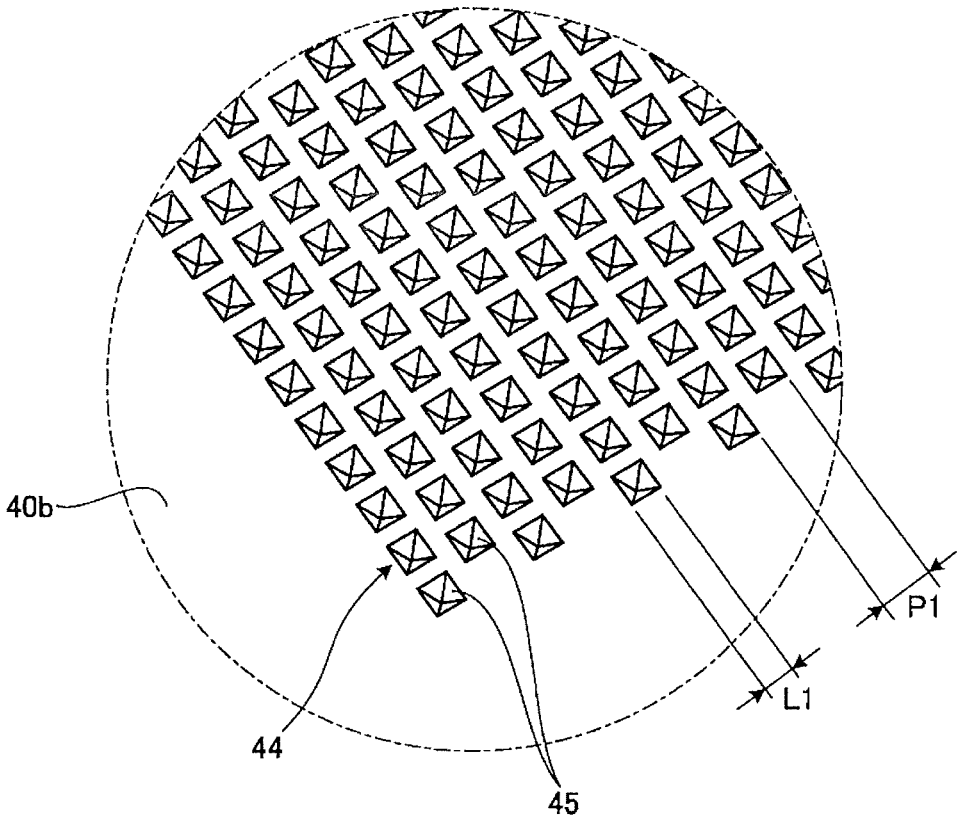

[FIG. 6]
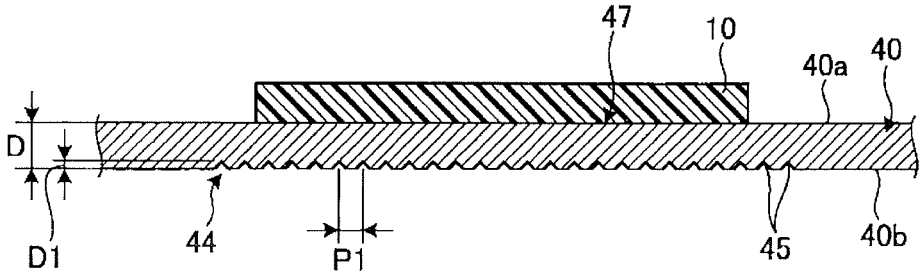

[FIG. 7]
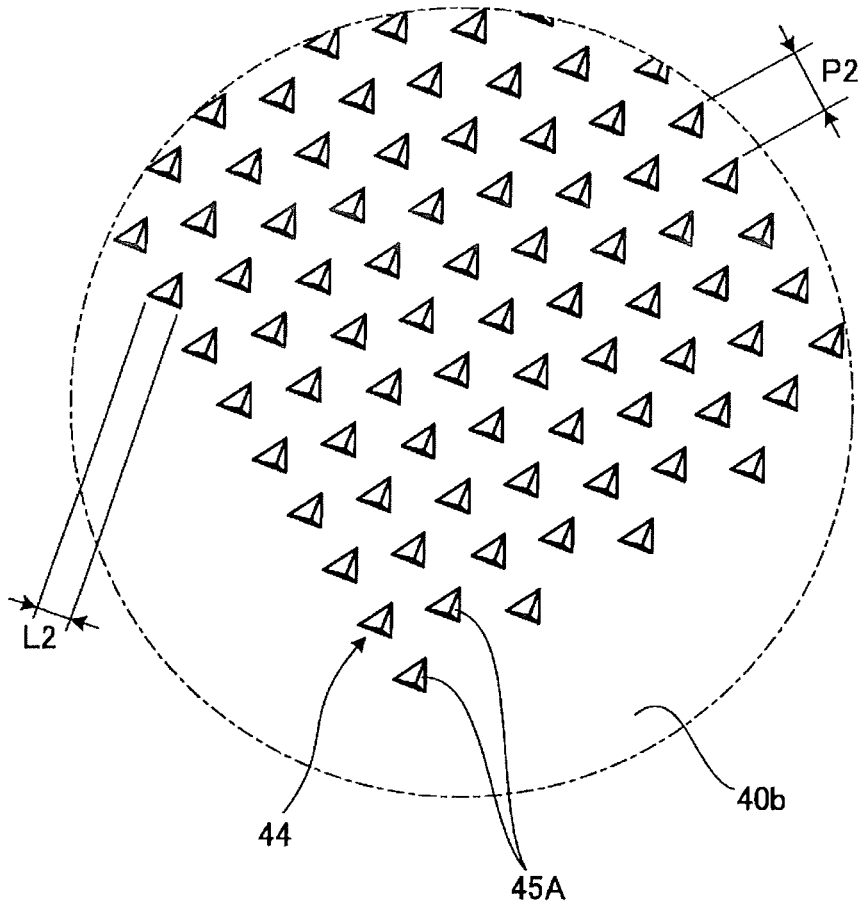

VEHICLE LAMP

TECHNICAL FIELD

The present invention relates to a vehicular lamp.

BACKGROUND ART

A vehicular lamp to be fixed to a vehicle has a configuration including a substrate, a semiconductor light source mounted on the substrate, a lens emitting the light from the semiconductor light source in the forward direction, and a plate-like heat sink to which the substrate and the lens are fixed. In this configuration, the substrate is fixed in contact with a plate face of the heat sink. Thus, the heat generated at the semiconductor light source is transferred to the heat sink through the substrate and radiated from the heat sink. In a known method of producing a heat sink, for example, a metal member in the form of a coil is led out and then subjected to leveling and/or punching (for example, refer to PTL 1).

CITATION LIST

Patent Literature

PTL 1: Japanese Unexamined Patent Application Publication No. 2013-131388

SUMMARY OF THE INVENTION

Problems to be Solved by the Invention

However, in the production method according to PTL 1, the metal member that was in the form of a coil may have residual stress (curling) even after leveling. Thus, the heat sink may curve due to the residual stress and cause a gap to form between the heat sink and the substrate. In such a case, the transfer of heat from the substrate to the heat sink is suppressed, thereby reducing heat radiation.

An object of the present invention, which has been conceived in light of the above-described circumstances, is to provide a vehicular lamp having excellent heat radiating properties.

Means for Solving the Problem

A vehicular lamp according to the present invention, comprising: a substrate; a semiconductor light source mounted on the substrate; an optical element emitting light from the semiconductor light source; and a heat radiating element comprising a plate-like metal material, having a first flat face fixed in contact with the substrate and supporting the optical element and a second flat face disposed on the back side of the first face, and being plastically deformed by a plurality of recesses disposed in a predetermined pattern in an area on the second face including an area corresponding to the back side of the area of the first face in contact with the substrate.

The vehicular lamp according to the present invention, wherein, the substrate is fixed to the heat radiating element with a threaded member, the heat radiating element has a screw hole penetrating the first face and the second face and receives the threaded member in the screw hole, and the recesses are disposed around the screw hole while leaving space around the screw hole.

The vehicular lamp according to the present invention, wherein the threaded member comprises a self-tapping screw.

The vehicular lamp according to the present invention, wherein the heat radiating element is disposed in a state with residual stress causing bending.

The vehicular lamp according to the present invention, wherein the recesses each has a polygonal shape.

Effect of the Invention

According to the present invention, a vehicular lamp having excellent heat radiating properties can be provided.

BRIEF DESCRIPTION OF THE DRAWINGS

FIG. 1 is a perspective view illustrating an example vehicular lamp according to an embodiment.

FIG. 2 is a perspective view illustrating an example vehicular lamp according to an embodiment.

FIG. 3 is an exploded perspective view of a vehicular lamp according to an embodiment.

FIG. 4 illustrates a configuration of a heat sink viewed from the rear.

FIG. 5 is a perspective view of the region A in FIG. 4.

FIG. 6 is a cross-sectional view of the configuration taken along line B-B in FIG. 4.

FIG. 7 is a perspective view of recesses according to a modification.

MODE FOR CARRYING OUT THE INVENTION

A vehicular lamp according to embodiments of the present invention will now be described with reference to the drawings. Note that the scope of the present invention should not be limited by the embodiments. The components according to the embodiments described below include those that can and readily be replaced with other components by one skilled in the art or those that are substantially the same.

In the descriptions below, the front-rear, up-down, and left-right directions indicate direction from the viewpoint of a driver riding in the vehicle while the vehicular front light is disposed on a surface parallel to a horizontal plane. Thus, in this embodiment, the up-down direction is the vertical direction, the front-rear and left-right directions are directions parallel to a horizontal plane (horizontal directions).

FIGS. 1 and 2 are perspective views of an example vehicular lamp 100 according to an embodiment. FIG. 1 illustrates a configuration of the vehicular lamp 100 viewed from the front. FIG. 2 illustrates a configuration of the vehicular lamp 100 viewed from the rear. FIG. 3 is an exploded perspective view of the vehicular lamp 100 according to this embodiment.

With reference to FIGS. 1 to 3, the vehicular lamp 100 includes a substrate 10, a semiconductor light source 20, a lens (optical element) 30, and a heat sink (heat radiating element) 40. The semiconductor light source 20 is mounted on the substrate 10. The substrate 10 has a rectangular plate-like shape. The substrate 10 includes a predetermined circuit feeding electrical signals to the semiconductor light source 20, connectors connected to the circuit, and other components.

The substrate 10 is fixed to the heat sink 40 with threaded members 13. The threaded members 13 are, for example, self-tapping screws. Thus, the substrate 10 can be fixed to the heat sink 40 without the use of nuts and other components. The substrate 10 is disposed in contact with the heat sink 40 via a thermal conductor, such as grease or a sheet. Thus, the substrate 10 and the heat sink 40 come into tighter contact with each other in comparison to when the substrate 10 and the heat sink 40 are in direct contact with each other, and heat transfer from the substrate 10 to the heat sink 40 is enhanced.

The semiconductor light source 20 according to this embodiment is, for example, an LED, an OEL, or an OLED (organic Els). The semiconductor light source 20 is, for example, a plurality of semiconductor light sources 20 or alternatively, a single semiconductor light source 20. A plurality of semiconductor light sources 20 are disposed in the left-right direction at a constant pitch. Alternatively, the plurality of semiconductor light sources 20 may be disposed at any pitch besides a constant pitch. Each of the semiconductor light sources 20 has a light-emitting face. The light-emitting face, for example, faces the front of the vehicle. The semiconductor light source 20 emits light from the light-emitting face toward the front of the vehicle such that the light forms a Lambertian distribution.

The lens 30 is disposed in front of the semiconductor light source 20. The lens 30 has an incident face and an emission face. The incident face faces the light-emitting face of the semiconductor light source 20. The light from the semiconductor light source 20 is directly incident on the incident face. The emission face faces the front. The emission face emits the light entering the incident face to the front of the vehicle. The lens 30 is held by a lens holder 35. The lens holder 35 holding the lens 30 is fixed to the heat sink 40 with fixing members 36, such as screws.

The heat sink 40 is composed of, for example, a metal, such as aluminum. The heat sink 40 is formed by, for example, leading out a metal member in the form of a coil and pressing the led our metal member into a rectangular plate-like shape. The heat sink 40 is disposed such that a first face 40*a* thereof faces the front and a second face 40*b* thereof faces the rear.

The heat sink 40 includes a substrate fixing portion 41 and lens holding portions 42. The substrate fixing portion 41 is disposed, for example, in the central portion of the heat sink 40 in the horizontal direction. The substrate fixing portion 41 is fixed while the first face 40*a* is in contact with the substrate 10. Thus, the first face 40*a* of the substrate fixing portion 41 is provided with a contact region 47 that comes into contact with the substrate 10. The contact region 47 is disposed in the central area of the substrate fixing portion 41 in the vertical and horizontal directions.

The substrate fixing portion 41 has screw holes 43. The screw holes 43 penetrate the first face 40*a* and the second face 40*b* of the substrate fixing portion 41. The screw holes 43 receive the threaded members 13 that fix the substrate 10. A total of two screw holes 43 are provided at the two edges in the horizontal direction. The number and position of the screw holes 43 are not limited to those described above. For example, the number of screw holes 43 may be one or three or more, and the screw holes 43 may be disposed at any positions besides those described above.

The lens holder 35 is fixed to the lens holding portions 42. The lens holding portions 42 hold the lens 30 by being fixed to the lens holder 35. The lens holding portions 42 are disposed on the two sides of the substrate fixing portion 41 in the horizontal direction. In this embodiment, the heat sink 40 bends forward from the lens holding portions 42 to the substrate fixing portion 41. The shape of the heat sink 40, however, is not limited to this and alternatively may, for example, have a flat shape.

FIG. 4 illustrates a configuration of the heat sink 40 viewed from the rear. As illustrated in FIG. 4, the substrate fixing portion 41 has a surface treated region 44. The surface treated region. 44 is disposed on the second face 40*b* in an area, for example, including the region corresponding to the back side of the contact region 47. That is, in this embodiment, the surface treated region 44 has an area larger than the area of the back side of the contact region 47. Note that the area of the back side of the contact region 47 is an area overlaying the contact region 47 in view of the normal direction of the second face 40*b*. That is, in this embodiment, the surface treated region 44 may be disposed in an area matching the area of the back side of the contact region 47. The surface treated region 44 has multiple recesses 45.

FIG. 5 is a perspective view of the region A in FIG. 4 and illustrates example recesses 45. As illustrated in FIG. 5, the recesses 45 each have a square pyramid shape. The length L1 of one side of each recess 45 can, for example, be smaller than or equal to half the thickness D of the heat sink 40 (see FIG. 6).

The recesses 45 are disposed at a predetermined pitch P1 in the vertical and horizontal directions of the surface treated region 44. The pitch P1 can, for example, be larger than or equal to twice the thickness D of the heat sink 40 (see FIG. 6). Note that the pitch in the vertical direction may differ from the pitch in the horizontal direction. The recesses 45 are disposed evenly across the entire surface treated region 44.

The heat sink 40 is in a plastically deformed state by providing the recesses 45 in the surface treated region 44 of the second face 40*b*. Thus, the heat sink 40 has enhanced flatness on the first face 40*a* in the area of the back side of the surface treated region 44. Note that flatness indicates the deviation from a geometrically correct flat surface of a planar body (Japanese Industrial Standards). Flatness is represented by the distance between two geometrically parallel flat planes when a planar body is disposed between the two flat planes disposed at a minimum distance (Japanese Industrial Standards).

In this embodiment, the surface treated region 44 has an area larger than the area of the contact region 47. Thus, the entire contact region 47 has enhanced flatness. Thus, a gap does not readily form between the substrate 10 and the contact region 47 when they are in surface contact.

The heat sink 40 has a large surface area due to the recesses 45 in the second face 40*b*. Thus, the surface treated region 44 having the recesses 45 has enhanced heat radiating properties.

FIG. 6 is a cross-sectional view of the configuration taken along line B-B in FIG. 4. As illustrated in FIG. 6, the recesses 45 each have a predetermined depth D1 from the second face 40*b* of the heat sink 40. The depth D1 of the recesses 45 from the second face 40*b* of the heat sink 40 is smaller than or equal to 25% of the thickness D of the heat sink 40.

Since the depth D1 of the recesses 45 is smaller than or equal to 25% of the thickness D, the flatness of the first face 40*a* can be enhanced without any effect on the strength of the heat sink 40.

To produce the heat sink 40 described above, first, a metal member in the form of a coil is lead out, and then the curling of the metal member is corrected through leveling. After leveling, the metal member is pressed. Through pressing, the areas between the substrate fixing portion 41 and the lens holding portions 42 are bent, and the multiple recesses 45 are formed in the surface treated region 44 of the substrate fixing portion 41. By forming the recesses 45, the metal member plastically deforms, and the flatness of the face corresponding to the first face 40*a* is enhanced. Thus, for example, even when the metal member has residual stress after leveling, the flatness of the first face 40*a* can be enhanced.

Then, through punching, the screw holes 43 and 46 are formed in the metal member. After forming the screw holes 43 and 46, the metal member is cut into a predetermined shape, to provide the heat sink 40. Note that the processing steps are not limited to the order described above. Alternatively, for example, after the metal member is leveled, the metal member may be cut and then subjected to pressing and punching.

The operation of the vehicular lamp 100 having the configuration described above will now be described. The vehicular lamp 100 emits light from the light-emitting face of the semiconductor light source 20. The light is directly incident on the incident face of the lens 30 and is emitted from the emission face toward the front of the vehicle. The semiconductor light source 20 generates heat through emission of the light. The heat is transferred to the heat sink 40 through the substrate 10.

In this embodiment, the adhesion of the substrate 10 and the contact region 47 is in an enhanced state. Thus, heat is smoothly transferred from the substrate 10 to the heat sink 40. Thus, the heat generated at the semiconductor light source 20 certainly transfers from the substrate 10 to the heat sink 40 and radiates from the heat sink 40.

As described above, the vehicular lamp 100 according to this embodiment includes a substrate 10; a semiconductor light source 20 mounted on the substrate 10; a lens 30 that emits the light from the semiconductor light source 20; and a plate-like heat sink 40 composed of a metal, having a flat first face 40*a* fixed in contact with the substrate 10 and supporting the lens 30 and a flat second face 40*b* disposed on the back side of the first face 40*a*, and being in a plastically deformed state by a plurality of recesses 45 disposed in a predetermined pattern on a surface treated region 44 of the second face 40*b* including an area of the back side of a contact region 47.

Thus, the heat sink 40 has enhanced flatness on the first face 40*a* in the area of the back side of the surface treated region 44. Thus, the adhesion of the substrate 10 and the first face 40*a* is enhanced, and the conductivity of heat from the substrate 10 to the heat sink 40 is enhanced. The recesses 45 provided in the second face 40*b* increase the surface area of the heat sink 40, thereby improving the heat radiating properties. In this way, a vehicular lamp 100 having improved heat radiating properties is obtained.

In the vehicular lamp 100 according to this embodiment, the substrate 10 is fixed to the heat sink 40; the heat sink 40 has the screw holes 43 penetrating the first face 40*a* and the second face 40*b* and receiving the threaded members 13; and the recesses 45 are disposed around the screw holes 43 while leaving space around the screw holes 43. In this way, the screw holes 43 are prevented from deforming, and thus, the threaded members 13 can be certainly inserted into the screw holes 43, to certainly fix the substrate 10.

In the vehicular lamp 100 according to this embodiment, the threaded members 13 are self-tapping screws. In this way, the substrate 10 can be fixed to the heat sink 40 without providing nuts or other components on the second face 40*b*. If nuts are to be provided on the second face 40*b*, the multiple recesses 45 should be disposed in areas avoiding the nuts. Thus, by omitting the nuts or other components, the recesses 45 can be disposed in a large area on the second face 40*b*.

In the vehicular lamp 100 according to this embodiment, even when the heat sink 40 has residual stress and is in a state of bending, the heat sink 40 is in a plastically deformed state by the multiple recesses 45. Thus, the flatness of the first face 40*a* in the area on the back side of the surface treated region 44 can be enhanced.

In the vehicular lamp 100 according to this embodiment, the surface treated region 44 is disposed in an area larger than the area of the back side of the contact region 47, and thus the heat transferred from the substrate 10 to the heat sink 40 can be readily radiated from the second face 40*b*. In this way, a vehicular lamp 100 having improved heat radiating properties is obtained.

Furthermore, in the vehicular lamp 100 according to this embodiment, the recesses 45 each have a polygonal shape, thereby readily causing plastic deformation of the heat sink 40. In this way, a vehicular lamp 100 having improved heat radiating properties can be readily produced.

Although the present invention has been described on the basis of specific embodiments, the present invention is not limited to above embodiments. For example, in an embodiment described above, the recesses 45 each have a square shape. The shape of the recesses 45 is not limited thereto, and may be any other polygonal shape. Note that the shape of the recesses 45 is not limited to a polygon and alternatively may be a semi-circular shape, a conic shape, or any other shape.

FIG. 7 is a perspective view of recesses 45A according to a modification. As illustrated in FIG. 7, the recesses 45A may each have a regular tetrahedral shape. The length L2 of one side of each recesses 45A can, for example, be smaller than or equal to half the thickness D of the heat sink 40 (see FIG. 6).

The recesses 45A are disposed at a predetermined pitch P2 in the vertical and horizontal directions. The pitch P2 can, for example, be larger than or equal to twice the thickness D of the heat sink 40 (see FIG. 6). In such a case, the pitch in the vertical direction may differ from the pitch in the horizontal direction. The recesses 45A are disposed evenly across the entire surface treated region 44A. In this way, the flatness is adjusted to be uniform in the entire area of the first face 40*a* corresponding to the surface treated region 44A.

In the embodiments described above, the vehicular lamp 100 has a direct-irradiation type configuration in which the lens 30 is provided as an optical element, and the light from the semiconductor light source 20 is directly incident on the lens 30. However, the configuration is not limited thereto. For example, the vehicular lamp 100 may have a configuration (multi-reflector type, projector type, etc.) in which a reflector replaces the lens 30 as an optical element, or a combination of the lens 30 and the reflector is used as an optical element, and the light distribution pattern is formed by light from the semiconductor light source 20 reflected forward at the reflective face of the reflector.

DESCRIPTION OF REFERENCE NUMERALS

A region
P1, P2 pitch
10 substrate
13 threaded member
20 semiconductor light source
30 lens
35 lens holder
36 fixing member
40 heat sink
40*a* first face

40*b* second face
41 substrate fixing portion
42 lens holding portion
43, 46 screw hole
44, 44A surface treated region
45, 45A recess
47 contact region
100 vehicular lamp

The invention claimed is:

1. A vehicular lamp comprising:

a substrate;

a semiconductor light source mounted on the substrate;

an optical element emitting light from the semiconductor light source; and a heat radiating element composed of a plate-like metal member and having a first flat face fixing the substrate which is in contact therewith and supporting the optical element and a second flat face disposed on the back side of the first face, wherein a plurality of recesses are provided in a predetermined pattern in at least an area on the second face which is the back side of the area of the first face corresponding to the substrate, wherein the plurality of recesses are provided by plastic deformation of the plate-like member.

2. The vehicular lamp according to claim 1, wherein, the substrate is fixed to the heat radiating element with a threaded member, the heat radiating element has a screw hole penetrating the first face and the second face and receives the threaded member in the screw hole, and the plurality of recesses are disposed around the screw hole while leaving space around the screw hole.

3. The vehicular lamp according to claim 2, wherein the threaded member comprises a self-tapping screw.

4. The vehicular lamp according to claim 1, wherein the heat radiating element is disposed in a state with residual stress causing bending.

5. The vehicular lamp according to claim 1, wherein the plurality of recesses each has a polygonal shape.

* * * * *